8-107 SR
3/6/84 XR 4,435,248

United States Patent [19]
Arakawa

[11] 4,435,248
[45] Mar. 6, 1984

[54] PROCESS FOR PRODUCING PHOTOGRAPHIC PAPER

[75] Inventor: Shun Arakawa, Shizuoka, Japan

[73] Assignee: Fuji Photo Film Co., Ltd., Kanagawa, Japan

[21] Appl. No.: 212,008

[22] Filed: Dec. 1, 1980

[30] Foreign Application Priority Data

Nov. 30, 1979 [JP] Japan ..... 54-155115

[51] Int. Cl.[3] ..... D21D 3/00
[52] U.S. Cl. ..... 162/12; 162/78; 162/100; 162/201; 8/107; 427/326; 427/337; 427/444
[58] Field of Search ..... 162/12, 78, 201, 100, 162/136; 8/107; 427/326, 337, 444

[56] References Cited

U.S. PATENT DOCUMENTS

| | | | |
|---|---|---|---|
| 2,125,634 | 8/1938 | Heritage | 162/78 |
| 2,598,580 | 5/1952 | McEwen et al. | 162/78 |
| 2,613,579 | 10/1952 | McEwen | 162/78 |
| 3,423,283 | 1/1969 | Goodwald et al. | 162/78 |
| 3,455,777 | 7/1969 | Goodwald | 162/78 |

OTHER PUBLICATIONS

Calkin, *Modern Pulp and Paper Making*, (1957), pp. 312, 313.

*Primary Examiner*—Peter Chin
*Attorney, Agent, or Firm*—Sughrue, Mion, Zinn, Macpeak & Seas

[57] ABSTRACT

A process for producing photographic paper comprising bleaching a paper web containing from 0 to 65% by weight water is disclosed.

8 Claims, 1 Drawing Figure

PROCESS FOR PRODUCING PHOTOGRAPHIC PAPER

BACKGROUND OF THE INVENTION

The present invention relates to a process for producing photographic paper base. More particularly, it relates to a process for producing paper for photographic paper base having a high degree of whiteness.

As photographic paper bases, those produced by applying a colloidal solution of gelatin-barium sulfate to paper and thereafter drying, and those produced by extruding or laminating polyolefin and, particularly, polyethylene on paper according to an extrusion coating method have been generally used. It has been believed hitherto that, because high degree of whiteness is generally required for the paper used as a photographic paper base, highly bleached cellulose pulp having high degree of whiteness must necessarily be used as a raw material.

Many processes for bleaching such cellulose pulp have been known hitherto. Particularly, as a bleaching means for obtaining pulp having high degree of whiteness, a method that has been widely used includes a multiple-stage bleaching method effectively combining oxidation bleaching, reduction bleaching and alkali extraction to bleach chemical pulp (CP), such as kraft pulp (KP) or sulfite pulp (SP).

In all of these processes, the pulp is bleached in a step prior to the paper making step(s). For example, an aqueous dispersion of pulp fibers having a suitable concentration can be held in a bleaching tower or a bleaching bath for a desired time, and bleached by adding a suitable amount of a bleaching agent solution while controlling suitably the temperature and the pH. Furthermore, there are also processes in which the bleaching is carried out in a pulper or a beater in the paper stock preparation step. Though these processes are effective as processes for uniformly bleaching the pulp, they have the problem that a large amount of a bleaching agent solution is required, because the concentration of the bleaching agent to pulp is necessarily very low in the pulp slurry.

Furthermore, in the case of photographic paper, it is sufficient that only the surface part of the base has high degree of whiteness, therefore the above-described processes are uneconomical, because unnecessary bleaching is carried out.

SUMMARY OF THE INVENTION

An object of the present invention is to provide a process for producing photographic paper base by carrying out economical and effective bleaching.

As a result of extensive studies in order to attain the above-described object, it has now been found that effective bleaching can be carried out when a paper web formed from a pulp slurry is used for bleaching, said web having a significantly higher pulp concentration than that of the pulp slurry from which it is formed, and thus the present invention has been attained by bleaching a web containing from 0 to 65% water after production of the web.

DETAILED DESCRIPTION OF THE INVENTION

Figure 1:
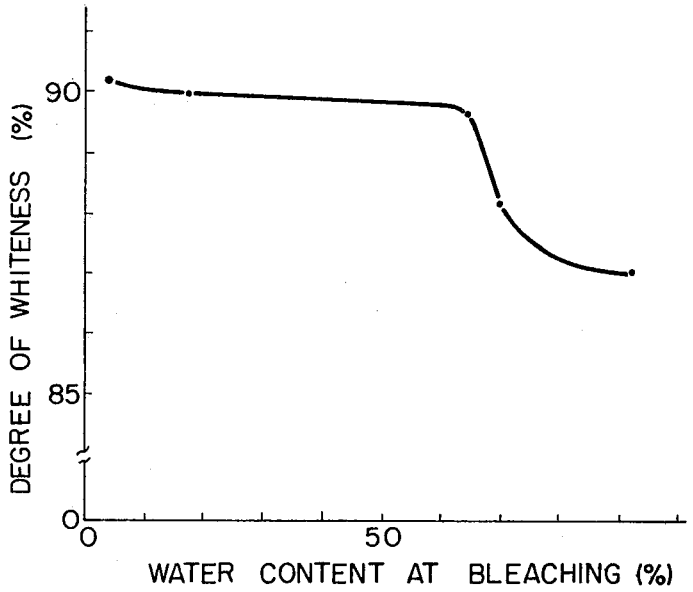
FIG. 1 is a graph showing the relation between water content at bleaching and degree of whiteness of web based upon the results shown in Table 1.

In order to improve the whiteness and to bleach a web without causing uneven bleaching, it is necessary that the water content of the web is 65% by weight or less and, preferably, 20% or less. If the water content is more than 65%, a large amount of the bleaching agent solution is required, because the ratio of the bleaching agent to the pulp becomes low, and uneven bleaching is easily caused.

According to the present invention, even if a web is produced using pulp having a lower degree of whiteness than that of the prior conventional pulp, it is possible to obtain uniform whiteness of the web, the degree of which is equal to that of previously known webs, using a very small amount of the bleaching agent solution as compared with the amounts used in bleaching pulp according to the prior art.

Processes for carrying out bleaching of the web containing from 0 to 65% water include (1) a process comprising impregnating webs with a suitable amount of the bleaching agent solution, alone or together with a sizing solution or other known chemicals for paper making in a size press step, a tub size step or an impregnation step, (2) a process which comprises spraying the bleaching agent solution by means of nozzles on a pipe positioned over the web and (3) a process which comprises applying the bleaching agent solution by means of a coating apparatus. Any of these processes can be incorporated in the paper making steps. In case that the present invention is carried out using a conventional paper machine, the sizing solution and the bleaching solution can be mixed in the size press step or the tub size step, by which effective bleaching can be attained.

In the case of carrying out the present invention using a size press, drying is suitably carried out at a drying temperature from 50° to 100° C. for from 30 seconds to 3 minutes. For example, when $H_2O_2$ (hydrogen peroxide) is used as the bleaching agent, whiteness can be sufficiently improved by drying at 80° C. for 40 seconds to 80 seconds of the drying time.

Pulp capable of being used for forming a web of the present invention includes bleached pulp and unbleached pulp. Not only chemical pulp (CP) such as sulfite pulp (SP) and kraft pulp (KP) but also ground pulp (GP), refiner-ground pulp (RGP), thermomechanical pulp (TMP) and chemi-ground pulp (CGP), etc., can be used. Further, webs that used in the present invention include those mixed with synthetic pulp, webs subjected to surface sizing, and webs coated with pigments, such as clay or kaolin, etc., or other surface treating chemicals.

The term "web" as used herein refers to a wet web formed in a paper making step for the purpose of utilizing the paper for photographic paper base (without substantial destruction of the network or paper laminar construction due to disintegration, etc., after paper making), including a web in each step of a conventional paper making process, such as a press step, a drying step, a calendering step, and a coating step, etc., and a paper (web) obtained through all of these steps.

In the bleaching agent solution used in the present invention, though generally known combinations such as that of $H_2O_2$ (hydrogen peroxide) as a bleaching agent and NaOH (sodium hydroxide), sodium silicate, magnesium salt or chelating agent, etc., as an auxiliary bleaching agent can be used, $H_2O_2$ is the most preferred from the viewpoint of bleaching effect, operation properties, and cost. A preferred amount of $H_2O_2$ to pulp required for bleaching is in a range of 0.1 to 5.0% by weight and, preferably, 0.4 to 1.0% by weight. As other bleaching agents, peracetic acid, hypochlorites, and dithionites can be used, which may be used in an amount of 0.03 to 5.0% by weight based on the pulp.

The bleaching agents used in the present invention include all of generally known bleaching chemicals used for paper making.

In the bleaching step of the present invention, the bleaching solution is spent wholly, and it is unnecessary to incorporate a rinsing step for complete removal of the bleaching solution.

In the following, the effect of the present invention is illustrated with reference to an example, but the present invention is not limited to the example.

Degree of whiteness of the webs obtained in Example 1 and Comparative Examples was measured by means of a Hanter whiteness tester using JIS-P8123.

EXAMPLE 1

After pulp having 86.5% of the degree of whiteness was beaten so as to have CSF (the term "CSF" as used herein refers to a "Canadian Schopper Freeness") 300 ml, sodium stearate was added thereto as a sizing agent in an amount of 2.0% by weight, based on the weight of the pulp, and paper making was carried out by a Fourdrinier paper machine, varying the paper-making conditions so as to have a density of 168.4 g/m$^2$ and containing 5.0% by weight water, a density of 195.0 g/m$^2$ and containing 18.0% by weight water, or a density of 457.1 g/m$^2$ and containing 65.0% by weight water, each of the foregoing having a bone-dry weight of 160 g/m$^2$. After the webs were impregnated with a bleaching solution (I) and pressed by means of a size press, they were dried at 80° C. for 2 minutes in the conventional drying step. The bleaching solution (I) used was produced by dissolving 50 g of $H_2O_2$ (35%), 15 g of sodium silicate and 7.5 g of NaOH in 1,000 ml of water, the temperature of which was kept at 40° C.

The size press was controlled so as to be impregnated with 30 ml of this solution based on 1 m$^2$ of the web.

COMPARATIVE EXAMPLE 1

After pulp having 86.5% of the degree of whiteness was beaten so as to have CSF 300 ml, sodium stearate was added thereto as a sizing agent in an amount of 2.0% by weight based on the weight of the pulp, and paper making was carried out by means of a Fourdrinier paper machine so as to have a density of 533.3 g/m$^2$ and contain 70.0% by weight water (with a bone-dry weight of 160 g/m$^2$).

Bleaching was carried out by the same manner as in Example 1 by means of a size press with using the bleaching solution (I).

COMPARATIVE EXAMPLE 2

After 160 g of absolutely dried pulp having 86.5% of the degree of whiteness was defiberized and dispersed in 2,000 ml of water to make a slurry, 30 ml of a bleaching solution having the same composition as that of the bleaching solution (I) in Example 1 was added to the slurry. This slurry was stirred for 30 minutes while maintaining the liquid temperature at 50° C. during bleaching. After pulp fibers were separated from the slurry, they were beaten so as to have CSF 300 ml and sodium stearate was added as a sizing agent in an amount of 2.0% by weight based on the pulp. Then, paper making was carried out by a Fourdrinier paper machine so as to have a density of 168.4 g/m$^2$ and contain 5.0% by weight water.

Results of the measurement are shown in Table 1 and FIG. 1. As is apparent from FIG. 1, the degree of whiteness of web was almost kept constant from 0 to about 65% by weight water and decreased suddenly thereafter. It is obvious from the results that the present invention is excellent in the degree of whiteness.

TABLE 1

| | Water Content at Bleaching (%) | Degree of Whiteness of Pulp (%) | Amount of Bleaching Solution Based on 1 m$^2$ (ml) | Degree of Whiteness of Web (%) |
|---|---|---|---|---|
| Example 1 | 5.0 | 86.5 | 30 | 90.2 |
| | 18.0 | 86.5 | 30 | 90.0 |
| | 65.0 | 86.5 | 30 | 89.6 |
| Comparative Example 1 | 70.0 | 86.5 | 30 | 88.1 |
| Comparative Example 2 | *92.0 | 86.5 | 30 | 87.0 |

*Slurry

While the invention has been described in detail and with reference to specific embodiments thereof, it will be apparent to one skilled in the art that various changes and modifications can be made therein without departing from the spirit and scope thereof.

What is claimed is:

1. A process for producing photographic paper comprising bleaching a paper web containing from 0 to 65% by weight water, using a size press and drying said web at a temperature of from 50° C. to 80° C. for 30 seconds to 3 minutes, wherein the bleaching agent is $H_2O_2$ used in an amount of from about 0.1% to 5.0% by weight, based on the weight of the pulp forming the paper web.

2. A process for producing photographic paper as in claim 1, wherein the web contains from 0 to 20% by weight water.

3. A process for producing photographic paper as in claim 1, wherein the webs are selected from the group consisting of those mixed with synthetic pulp, webs subjected to surface sizing, and webs coated with pigments or other surface treating chemicals.

4. A process for producing photographic paper as in claim 1, wherein the web is selected from the group consisting of a wet web formed in a step of the paper making process selected from a press step, a drying step, a calendering step, and a web obtained from a combination of these steps.

5. A process for producing photographic paper as in claim 1, 2, 3 or 4, wherein the pulp used for forming the web includes bleached pulp and unbleached pulp.

6. A process for producing photographic paper as in claim 5, wherein the pulp is selected from the group consisting of sulfite pulp (SP), kraft pulp (KP), ground pulp (GP), refiner-ground pulp (RGP), thermomechanical pulp (TMP) and chemical ground pulp (CGP).

7. A process for producing photographic paper as in claim 1, wherein drying is carried out at a temperature of 80° C. for from 40 seconds to 80 seconds.

8. A process for producing photographic paper as in claim 3, wherein the web is coated with clay or kaolin.

* * * * *